US007600474B2

(12) United States Patent
Oh

(10) Patent No.: US 7,600,474 B2
(45) Date of Patent: Oct. 13, 2009

(54) APPARATUS AND METHOD OF FABRICATING BLANKET FOR PRINTING ROLL

(75) Inventor: Tae Young Oh, Anyang-si (KR)

(73) Assignee: LG. Display Co., Ltd., Seoul (KR)

( * ) Notice: Subject to any disclaimer, the term of this patent is extended or adjusted under 35 U.S.C. 154(b) by 472 days.

(21) Appl. No.: 11/271,259

(22) Filed: Nov. 8, 2005

(65) Prior Publication Data

US 2006/0207455 A1 Sep. 21, 2006

(30) Foreign Application Priority Data

Mar. 17, 2005 (KR) ..... 10-2005-0022264

(51) Int. Cl.
*B41L 35/14* (2006.01)

(52) U.S. Cl. ..... 101/488; 101/487

(58) Field of Classification Search ..... 101/488, 101/487

See application file for complete search history.

(56) References Cited

U.S. PATENT DOCUMENTS 2,319,242 A * 5/1943 Lipsius ..... 118/60
2,861,897 A * 11/1958 Hendrixson ..... 427/318
5,544,584 A * 8/1996 Thompson et al. ..... 101/401.1
5,985,080 A * 11/1999 Kobayashi et al. ..... 156/244.24
5,992,320 A * 11/1999 Kosaka et al. ..... 101/401.1
6,616,974 B1 * 9/2003 Lorig et al. ..... 427/271
2003/0000403 A1 1/2003 Vrotacoe et al.
2003/0056669 A1 * 3/2003 Miller et al. ..... 101/401.1
2004/0265553 A1 12/2004 Rockwell et al.

* cited by examiner

*Primary Examiner*—Anthony H. Nguyen
(74) *Attorney, Agent, or Firm*—Brinks Hofer Gilson & Lione

(57) ABSTRACT

An apparatus and method for fabricating a blanket for a printing roll for is provided. The apparatus includes a container to receive and drop printing roll blanket material for patterning an LCD substrates, a preheating part below the container to preheat dropped printing roll blanket material and a curing part below the preheating part to cure preheated printing roll blanket material. The method includes dropping printing roll blanket material for patterning an LCD substrate from a container, preheating the dropped printing roll blanket material and curing the preheated printing roll blanket material.

8 Claims, 10 Drawing Sheets

APPARATUS AND METHOD OF FABRICATING BLANKET FOR PRINTING ROLL

This application claims the benefit of priority under 35 U.S.C. § 119 to Korean Patent Application No. P2005-22264, filed on Mar. 17, 2005.

BACKGROUND OF THE INVENTION

1. Field of the Invention

The present invention relates to a printing roll used in a printing method, and more particularly, to a blanket which may be adhered to a printing roll.

2. Discussion of the Related Art

The process of making an LCD or semiconductor device typically involves depositing a plurality of layers and etching the coated layers. In particular, CVD (Chemical Vapor Deposition) and sputtering methods are used to deposit layers, while photolithographic methods are used to etch the coated layers.

When forming a plurality of layers, complexities associated with deposition and etching can account for reduced productivity. Therefore, efficient mass production of LCD or semiconductor devices requires more simplified deposition and etching processes.

Compared with photolithographic processes for patterning coated layers, patterning processes employing printing are simpler and easier to accomodate.

When forming a desired pattern by printing, a predetermined material is coated in a desired pattern on a printing roll. To form the desired pattern on a substrate, the material printed on the printing roll is re-printed on the surface of the substrate by rolling the printing roll on the substrate. Because of their simplicity, patterning methodologies involving printing lend themselves favorably to processes demanding more efficient mass production.

FIGS. 1A to 1C are cross sectional views depicting a printing method according to the related art. As shown in FIG. 1A, printing material 20 is coated on a printing plate 10 in a predetermined pattern. When a printing roll 30 is rolled on the coated printing plate 10, the printing material 20 is printed on a blanket 35 disposed on the printing roll 30 (FIG. 1B). Then, the printing roll 30 containing the printing material 20 is rolled on a substrate 40 to re-print the printing material 20 thereon. As a result, the printing material 20 is formed in a predetermined pattern on the substrate 40.

FIGS. 2A and 2B illustrate a process for fabricating a blanket according to the related art. First, a mold 50 having a concave part 55 in a predetermined shape is prepared (FIG. 2A). The concave part of the mold 50 is then filled with a resin material used to form the blanket (FIG. 2B). To fabricate the blanket 35, the pressure part 60 applies a predetermined pressure to the resin material in the mold 50.

It is difficult obtain an accurate pattern using such a blanket, however. This may be attributed to imperfections in the concave part 55 when forming the mold 50 and to reduced pressure uniformity when the pressure part 60 is lowered.

If the non-uniform blanket is used, a defect may arise when printing the printing material on the blanket. FIG. 3 illustrates how a defect may be generated when a imperfect blanket 35 is used according to the related art. If, for example, a portion 35*a* of the blanket 35 is protruding, a non-designated portion 20*a* of printing material may be inadvertently printed on the blanket 35, thereby producing an undesired pattern on a substrate thereafter.

SUMMARY OF THE INVENTION

The present invention is directed to an apparatus and method for fabricating a blanket for a printing roll, which obviate one or more problems in the related art.

In one aspect, the present invention provides a method for fabricating a blanket for a printing roll, which includes dropping printing roll blanket material for patterning an LCD substrate from a container; preheating the printing roll blanket material; and curing the printing roll blanket material to form a cured blanket.

In a further aspect, the present invention provides an apparatus for fabricating a blanket suitable for a printing roll, where the apparatus includes a container configured to receive printing roll blanket material for patterning an LCD substrate and to drop the printing roll blanket material therefrom; a preheating part below the container, the preheating part configured to preheat dropped printing roll blanket material; and a curing part below the preheating part, the curing part configured to cure preheated printing roll blanket material. The apparatus may further include a rotation roll below the preheating part, where the curing part is positioned along the circumference of the rotation roll.

BRIEF DESCRIPTION OF THE DRAWINGS

The accompanying drawings illustrate aspects and principles of the present invention.

DETAILED DESCRIPTION OF THE INVENTION

Reference will now be made in detail to embodiments exemplifying the present invention in accordance with the specification, claims and accompanying drawings. Wherever possible, the same reference numbers will be used throughout the drawings to refer to the same or like parts.

Figure 1A:
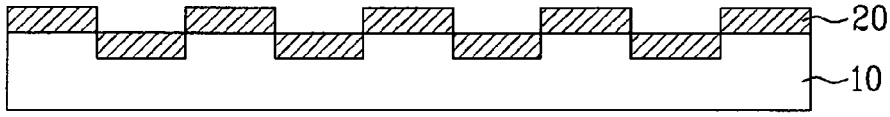
FIG. 1A Related Art
FIGS. 1A to 1C are cross sectional views of a printing method according to the related art.
Figure 1B:
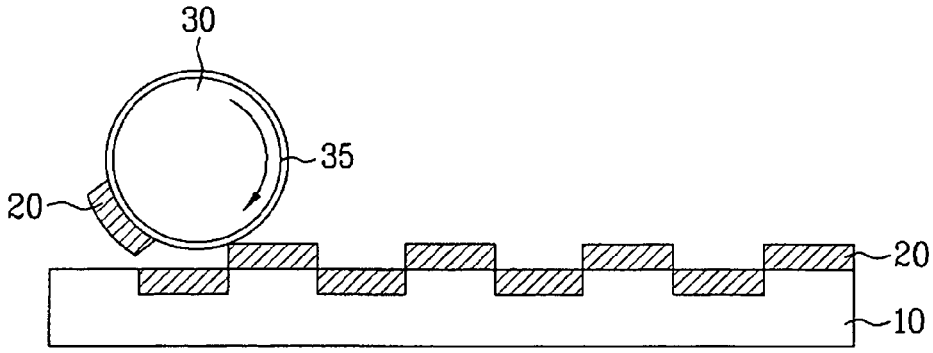
FIG. 1B Related Art
Figure 1C:
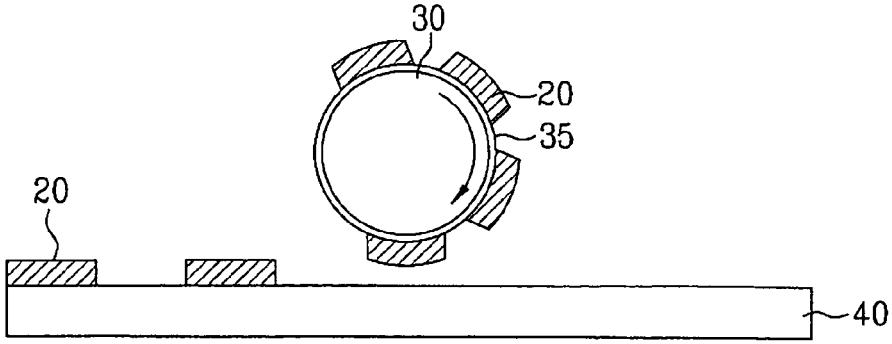
FIG. 1C Related Art
Figure 2A:
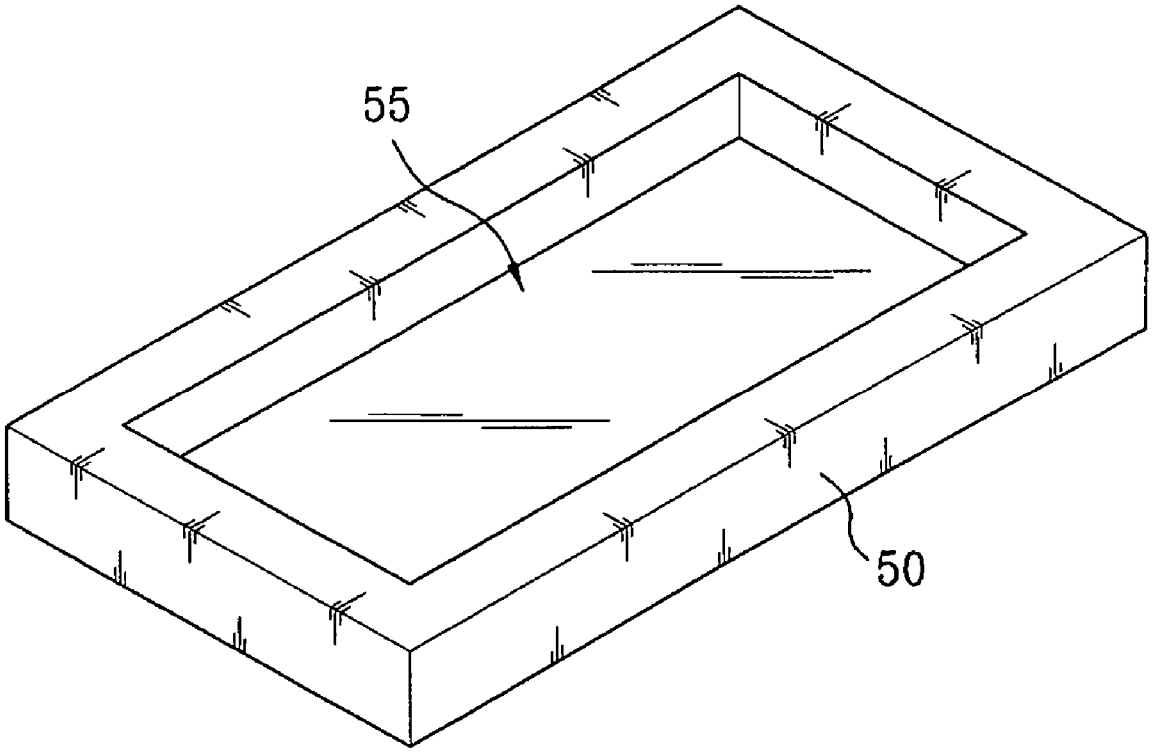
FIG. 2A Related Art
FIGS. 2A and 2B are schematic views of a process for fabricating a blanket according to the related art.
Figure 2B:
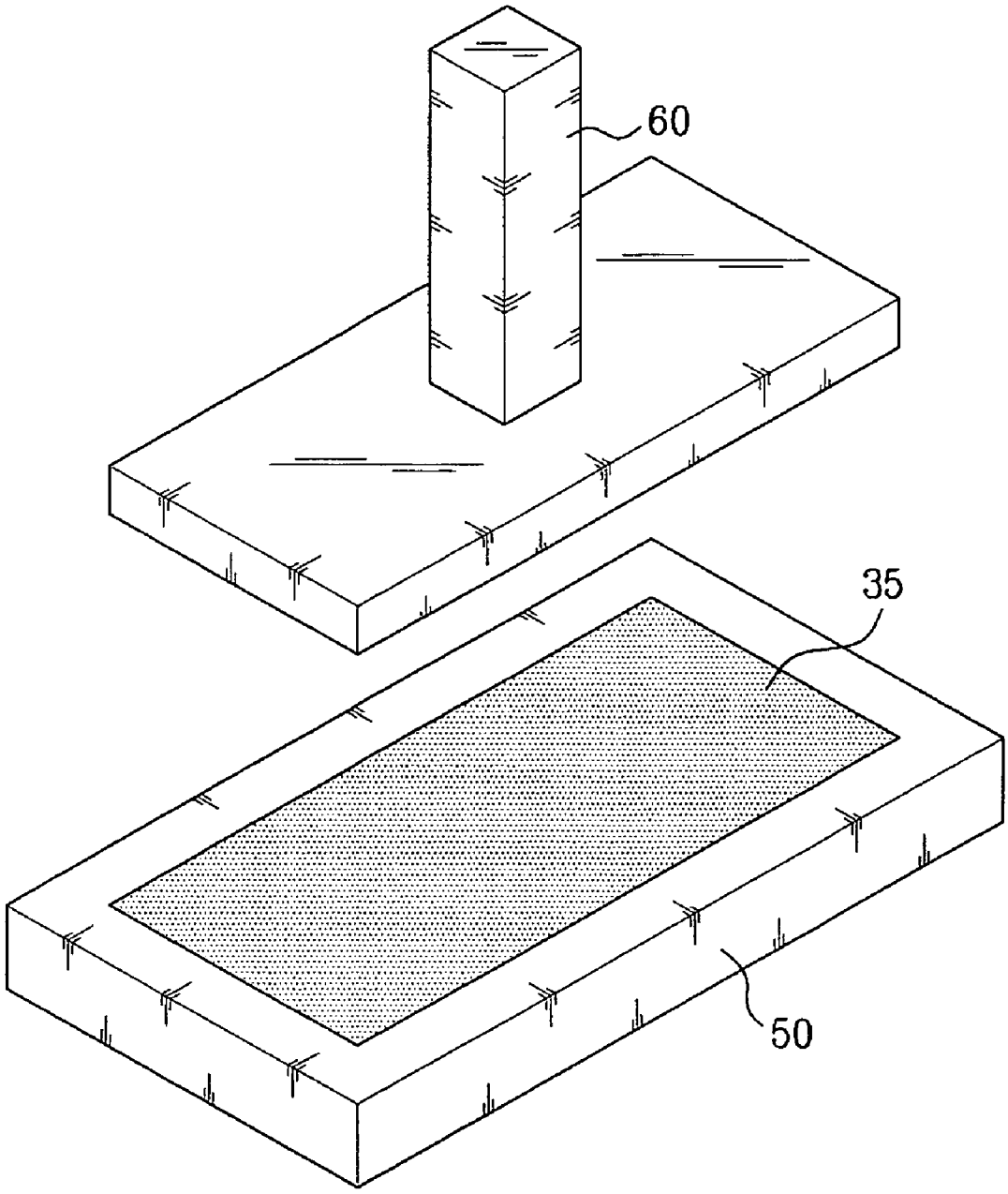
FIG. 2B Related Art
Figure 3:
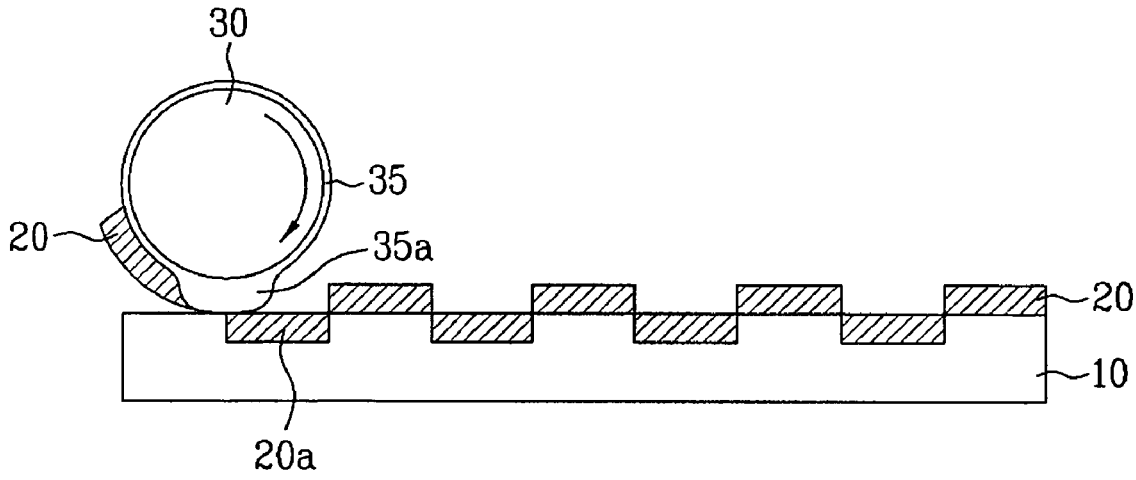
FIG. 3 Related ARt
FIG. 3 is a schematic view illustrating the nature of defect obtained using an imperfect blanket according to the related art.
Figure 4:
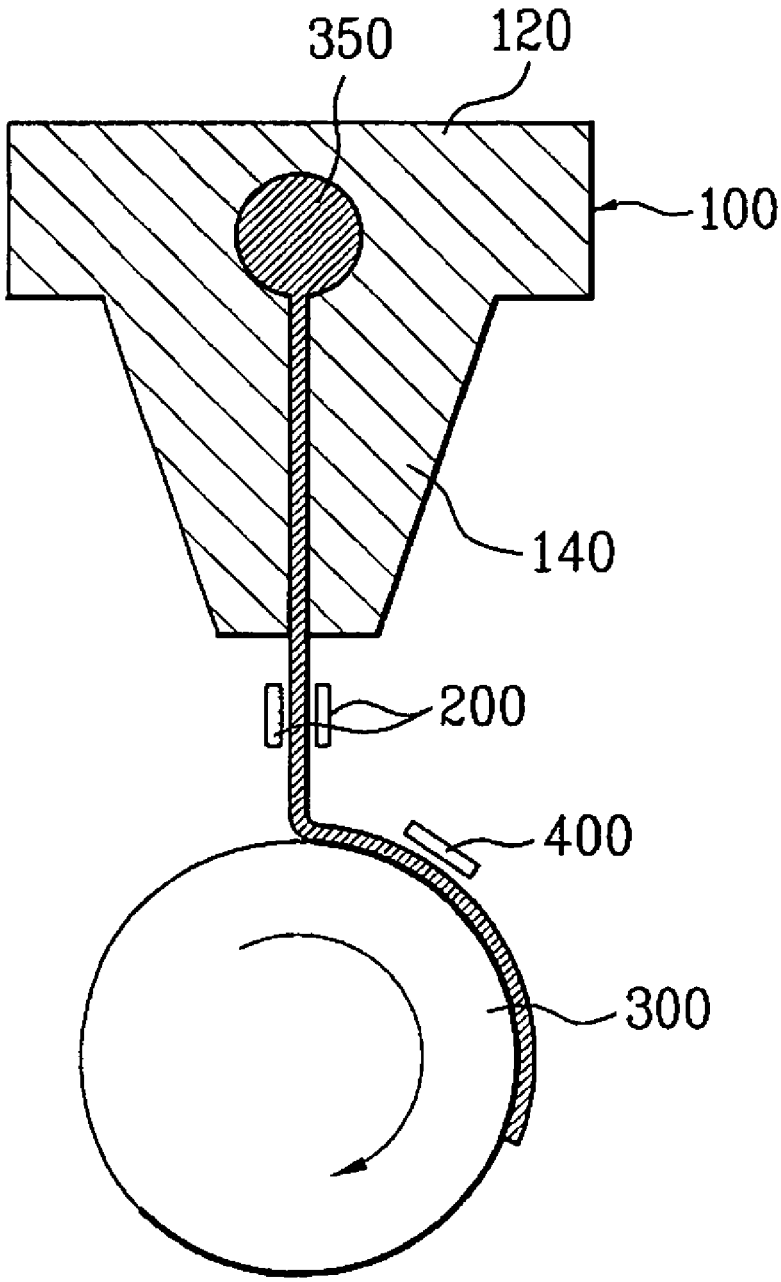
FIG. 4 is a schematic view of an apparatus and method for fabricating a blanket according to an embodiment of the present invention.

FIG. 4 depicts an exemplary apparatus for fabricating a blanket according to one embodiment of the present invention. The apparatus includes a container 100, a preheating part 200, a rotation roll 300 and a curing part 400.

Figure 5A:
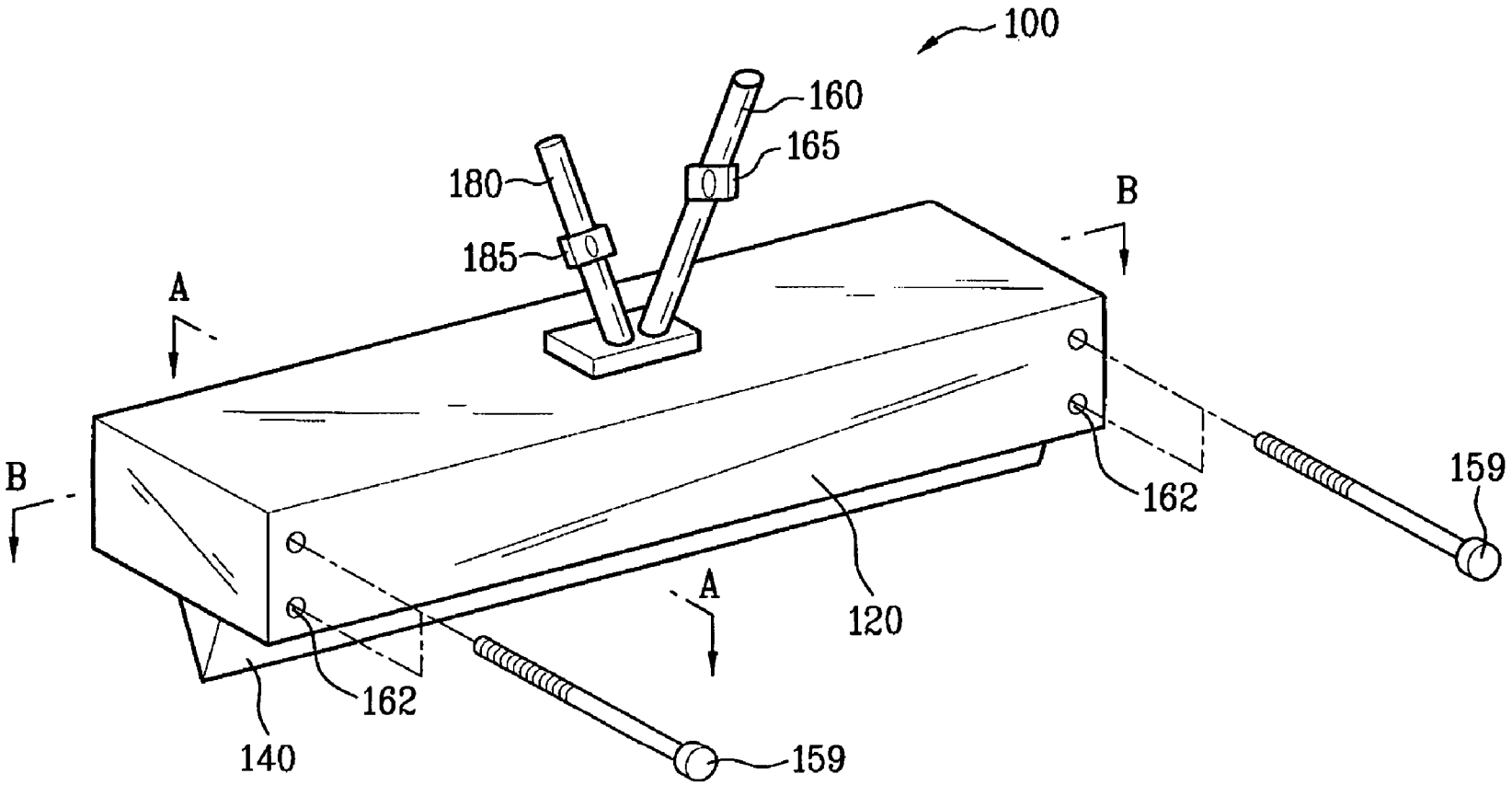
FIG. 5A is a perspective view of a container according to an embodiment of the present invention.
Figure 5B:
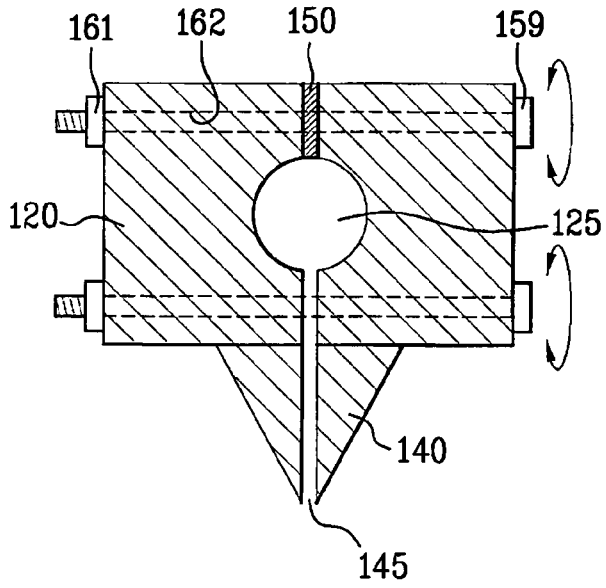
FIG. 5B is a cross sectional view along A-A' of FIG. 5A.
Figure 5C:
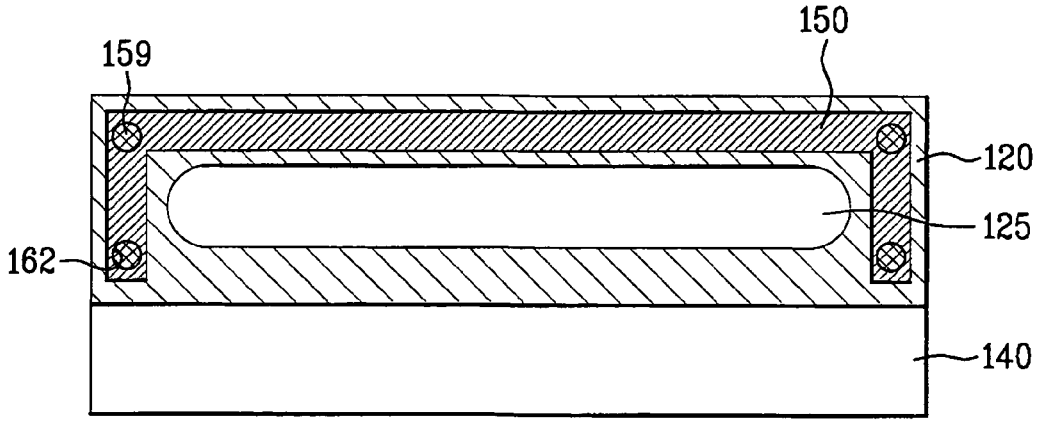
FIG. 5C is a cross sectional view along B-B' of FIG. 5A.
Figure 6A:
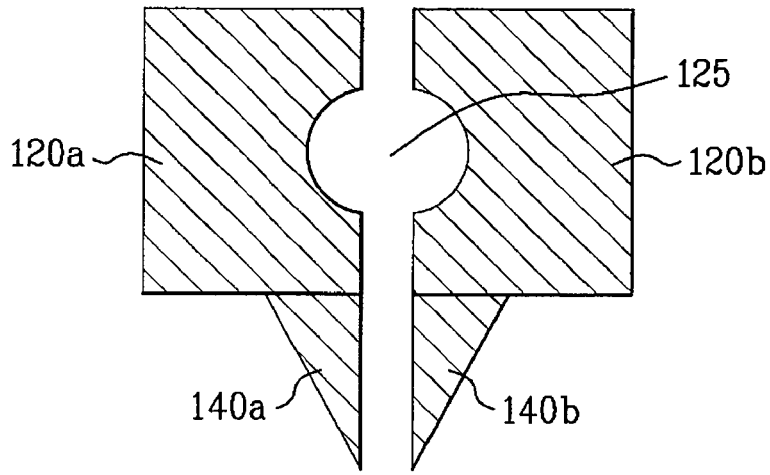
FIGS. 6A and 6B are cross sectional views of two containers according to the present invention.
Figure 6B:
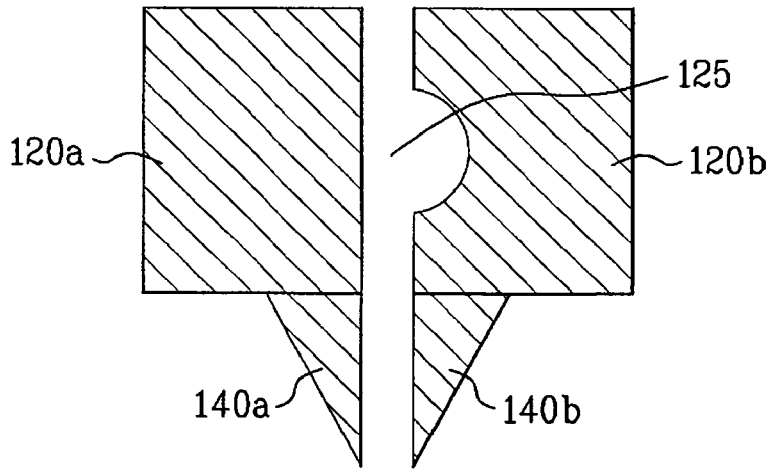

FIG. 5A is a perspective view of an exemplary container according to the present invention. FIG. 5B is a cross sectional view along A-A' of FIG. 5A; FIG. 5C is a cross sectional view along B-B' of FIG. 5A. FIGS. 6A and 6B are cross sectional views of a container.

The container 100 receives blanket material 350 and drops the blanket material 350 therefrom (FIG. 4). The container 100 is provided with a body 120 and a nozzle 140. The body 120 includes a hole for receiving blanket material 350 and the nozzle 140 includes a slit for dropping the blanket material therefrom to form a blanket. Although the container 100 in FIGS. 5 and 6 includes one body 120 and one nozzle 140, the container may include a plurality of bodies 120 and nozzles 140.

The container 100 in FIG. 5A includes a body 120, a nozzle 140, a supplying tube 160, and an exhaust tube 180. The nozzle 140 is provided below the body 120. The supplying tube 160 supplies the body 120 with blanket material. The exhaust tube 180 exhausts material from the body 120.

The supplying tube 160 is connected to an accommodation groove 125 in which blanket material is supplied. The supplying tube 160 includes a valve 165 controlling the amount of material supplied to the accommodation groove for making the 125 blanket.

The exhaust tube 180, which is connected to an accommodation groove 125 in the body 120, exhausts material from the accommodation groove 125 to the outside of the container 100 (FIG. 5A). The exhaust tube 180 has a valve 185.

It is necessary to periodically clean the container 100. Before cleaning the container 100, material remaining in the container 100 may be exhausted to the outside through an exhaust tube 180. In the course of cleaning the container 100, detergent remaining therein may be subsequently exhausted through the exhaust tube 180 to the outside. Thus, the exhaust tube 180 can be used to exhaust material and detergent to the outside.

FIGS. 5B and 5C depict an accommodation groove 125 in the body 120 for receiving blanket material. The accommodation groove 125 is connected to a nozzle 140 having a slit 145 for dropping the blanket material down.

The size of the slit 145 may be modified to control the flow of blanket material therethrough. For example, FIG. 5B depicts a body 120, including a spacer 150, a plurality of through holes 162, and a plurality of bolts 159 and nuts 161 coupled to each through hole 162. As depicted in FIG. 5B, the bolts 159 and nuts 162 may be operated to control the size of the slit 145 so as to control the flow of the dropped blanket material.

The container may include sub-containers, each having a sub-body 120*a* and 120*b* and a sub-nozzle 140*a* and 140*b* (FIGS. 6A and 6B). The accommodation groove 125 in the body 120 may be formed by the connection between two sub-accommodation grooves in sub-bodies 120*a* and 120*b* (FIG. 6A) or it may be formed from one sub-accommodation groove in either of sub-bodies 120*a* or 120*b* (FIG. 6B).

A preheating part 200 below the container 100 preheats dropped material to achieve a predetermined hardness in the blanket material 350*a*. Preferably, the preheating part 200 includes a heater.

Figure 7A:
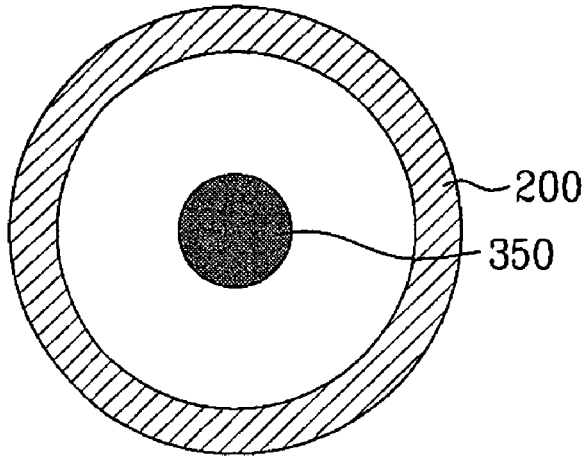
FIGS. 7A and 7B are cross sectional views illustrating a preheating part according to the present invention.
Figure 7B:
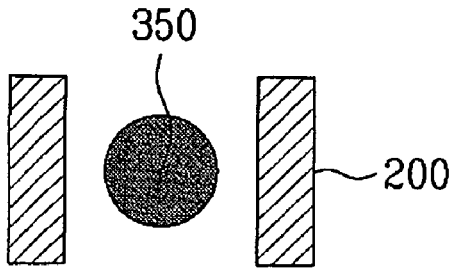

FIGS. 7A and 7B depict representative cross sections of the preheating part 200. In one embodiment, the preheating part 200 may completely surround the blanket material 350 (FIG. 7A). Alternatively, the preheating part 200 may be positioned in parallel sides facing the blanket material 350.

Below the preheating part 200 is a rotation roll 300 containing a surface to be coated by the dropped blanket material 350 (FIG. 4). Preferably, the rotation roll 300 has the same size as the printing roll on which a blanket may be adhered. Using a rotation roll identical in size to the printing roll simplifies the process of adhering a blanket to the printing roll.

When the blanket material 350 is coated on the surface of the rotation roll 300, the blanket material 350 may be adhered to the printing roll by a curing and cutting process. In one aspect, a curing part 400 may provided in the circumference of the rotation roll 300. The curing part 400 cures blanket material 350 coated on the rotation roll 300 (FIG. 4).

When using a blanket material 350 that includes thermal curing type material, the curing part 400 may include a heater. On the other hand, when using a blanket material 350 that includes UV curing type material, the curing part 400 may include a UV lamp.

Preferably, a cutting part is additionally provided along the circumference of the rotation roll 300. However, the cutting part is unnecessary when the rotation roll 300 serves as the printing roll. If, however, a separate printing roll is used, a cutting part may be provided to cut the cured blanket material 350 adhered to the rotation roll 300.

The following method may be used to fabricate a blanket with the aforementioned apparatus. First, appropriate blanket material 350 is dropped from the container 100. Then, the dropped blanket material 350 is preheated and cured to obtain blanket material 350 having a desirable, predetermined hardness.

The blanket material 350 may be preheated using a preheating part 200, coated on the surface of a roll and then cured using a curing part 400. Preferably, the blanket material is preheated by a preheating part 200 at a temperature between 60° C. and 100° C.

The curing process may be varied depending on the type of blanket material 350. If the blanket material 350 includes thermal curing type material, the blanket material 350 may be cured at a temperature between 120° C. to 140° C. If the blanket material includes UV curing type material, it is preferable to use UV rays from a UV lamp. After the blanket material is cured, it may then be cut.

Figure 8:
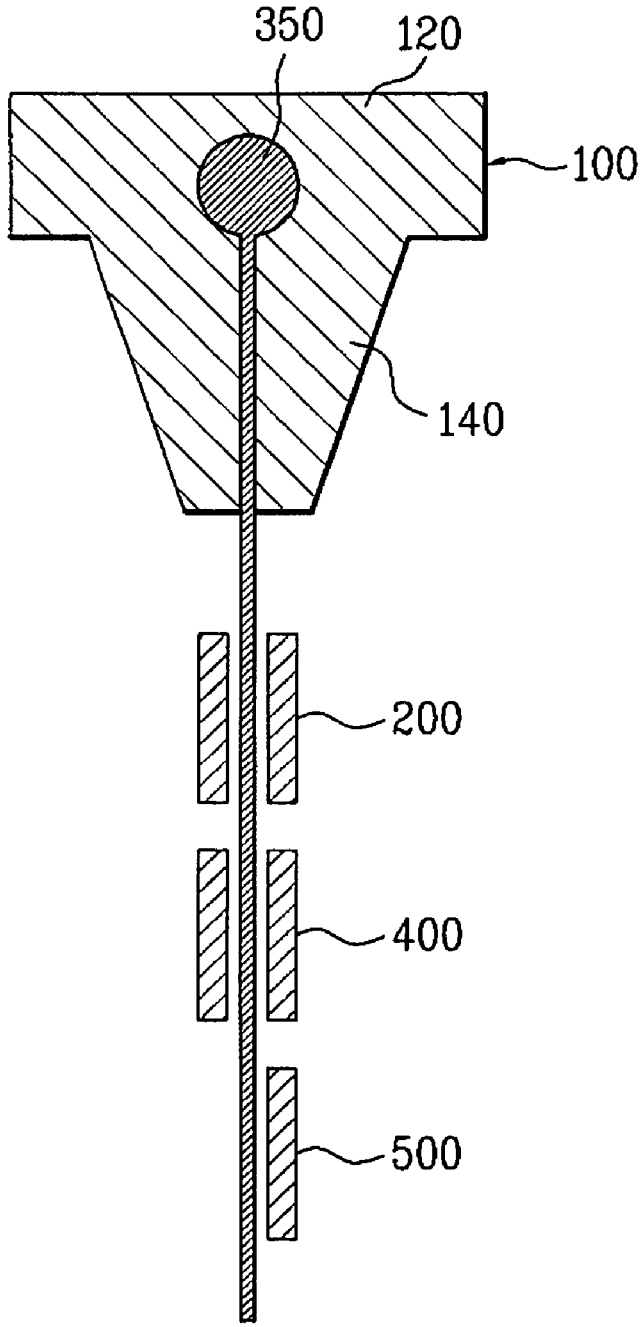
FIG. 8 is a schematic view of an apparatus for fabricating a blanket according to a particular embodiment of the present invention.

FIG. 8 depicts an apparatus for fabricating a blanket according to another embodiment of the present invention. The apparatus in FIG. 8 includes a container 100, a preheating part 200 and a curing part 400 underneath. The container 100, preheating part 200 and curing part 400 set forth in FIG. 8 follow the structures and accompanying disclosures above. A cutting part 500 may be additionally included below the curing part 400 as set forth in FIG. 8.

The process of fabricating a blanket with the apparatus exemplified in FIG. 8 is similar to the process for fabricating a blanket as already described above. That is, a blanket material 350 is received in the container 100 and then dropped. The dropped blanket material 350 is then preheated using a preheating part 200 cured to a desirable, predetermined hardness. The preheating process of the preheating part 200 may be carried out at a temperature between 60° C. and 100° C. Dropped blanket material 350, preheated by the preheating part 200, may then be cured by the curing part 400.

The process of curing by the curing part 400 may be changed depending on the type of blanket material. That is, if the blanket material includes a thermal curing type material, the blanket material may be cured at a temperature between 120° C. and 140° C. If the blanket material includes a UV curing type material, the blanket material may be cured using UV rays from a UV lamp. A cutting process may be utilized to cut the blanket material after completing the curing process.

The above described blanket fabrication methodology makes it possible to fabricate a blanket having a more uniform appearance without the defects associated blankets fabricated using molds according to the related art as described above.

It will be apparent to those skilled in the art that various modifications and variations can be made in the present invention without departing from the spirit or scope of the inventions. Thus, it is intended that the present invention cover the modifications and variations of this invention provided they come within the scope of the specification and the appended claims and their equivalents.

What is claimed is:

1. A method for fabricating a blanket for a printing roll comprising:

dropping printing roll blanket material for patterning an LCD substrate from a container to a rotation roll;

preheating the printing roll blanket material during dropping the printing roll blanket material from a container to a rotation roll using preheating part between the container and the rotation roll so as to obtain a predetermined hardness in the printing roll blanket material; and curing the printing roll blanket material to form a cured blanket.

2. The method of claim 1, further comprising coating the blanket material on the rotation roll.

3. The method of claim 2, wherein the steps of coating and curing the material are simultaneously performed.

4. The method of claim 1, wherein the steps of dropping, preheating and curing the material are continuously performed.

5. The method of claim 1, wherein the blanket material is preheated at a temperature between 60° C. and 100° C.

6. The method of claim 1, wherein the blanket material is cured at a temperature between 120° C. and 140° C.

7. The method of claim 1, wherein the blanket material is cured by irradiating the blanket material with UV rays.

8. The method of claim 1, further comprising cutting the cured blanket.

* * * * *

UNITED STATES PATENT AND TRADEMARK OFFICE

CERTIFICATE OF CORRECTION

PATENT NO. : 7,600,474 B2
APPLICATION NO. : 11/271259
DATED : October 13, 2009
INVENTOR(S) : Tae Young Oh It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 472 days.

Delete the phrase "by 472 days" and insert -- by 642 days --

Signed and Sealed this

Fourth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,600,474 B2
APPLICATION NO. : 11/271259
DATED : October 13, 2009
INVENTOR(S) : Tae Young Oh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 812 days.

Signed and Sealed this

Fifth Day of October, 2010

David J. Kappos

David J. Kappos
*Director of the United States Patent and Trademark Office*